US009994348B2

(12) United States Patent
Kling et al.

(10) Patent No.: US 9,994,348 B2
(45) Date of Patent: Jun. 12, 2018

(54) END PLUG FOR A PAPER ROLL

(71) Applicant: SCA HYGIENE PRODUCTS AB, Göteborg (SE)

(72) Inventors: Robert Kling, Skene (SE); Anders Andersson, Stenungsund (SE); Erik Hjort, Säter (SE)

(73) Assignee: SCA HYGIENE PRODUCTS AB, Göteborg (SE)

( * ) Notice: Subject to any disclaimer, the term of this patent is extended or adjusted under 35 U.S.C. 154(b) by 751 days.

(21) Appl. No.: 14/253,111

(22) Filed: Apr. 15, 2014

(65) Prior Publication Data

US 2014/0246535 A1 Sep. 4, 2014

Related U.S. Application Data

(62) Division of application No. 12/280,167, filed as application No. PCT/SE2007/050055 on Feb. 1, 2007, now Pat. No. 8,740,132.

(30) Foreign Application Priority Data

Mar. 27, 2006 (WO) ..... PCT/SE2006/050043

(51) Int. Cl.
*A47K 10/40* (2006.01)
*B65B 63/02* (2006.01)
(Continued)

(52) U.S. Cl.
CPC ..... *B65B 63/02* (2013.01); *A47K 10/38* (2013.01); *A47K 10/40* (2013.01); *B65H 75/185* (2013.01)

(58) Field of Classification Search
CPC ..... B65H 16/06; B65H 75/04; B65H 75/08; B65H 75/185; B65H 2402/412;
(Continued)

(56) References Cited

U.S. PATENT DOCUMENTS 4,032,077 A 6/1977 Baselice
4,171,781 A 10/1979 Kral et al.
(Continued)

FOREIGN PATENT DOCUMENTS

DE 4106972 A1 9/1991
GB 2 243 822 A 11/1991
(Continued)

OTHER PUBLICATIONS

Decision on Grant in corresponding Russian Applicaton No. 2008142427 dated Apr. 7, 2010.
(Continued)

*Primary Examiner* — William A. Rivera
(74) *Attorney, Agent, or Firm* — Buchanan Ingersoll & Rooney P.C.

(57) ABSTRACT

An end plug to be inserted axially into the centre of an end of a roll of paper, includes a holding element adapted to hold and/or guide the end of the roll of paper in correct position in a dispenser. The end plug includes an outer sleeve having an outer end and an inner end and the holding element is connected to the sleeve by elements allowing the holding element to be axially moved from a first position to a second position, in which the holding element protrude outwardly from the outer end of the sleeve, the holding element being releasably held in the first position when moved thereto. A roll of tissue paper including such an end plug and a dispenser provided with such a roll are also disclosed.

15 Claims, 11 Drawing Sheets

(51) Int. Cl.
*B65H 75/18* (2006.01)
*A47K 10/38* (2006.01)

(58) Field of Classification Search
CPC ..... B65H 2301/41346; B65H 2301/41369; B65H 2511/12; B65H 2220/04; A47K 10/40; A47K 2010/3206
See application file for complete search history.

(56) References Cited

U.S. PATENT DOCUMENTS

| | | | | |
|---|---|---|---|---|
| 4,383,656 | A | 5/1983 | Campbell | |
| 4,901,889 | A * | 2/1990 | Mitchell | A47K 10/32 222/153.11 |
| 5,322,234 | A | 6/1994 | Robert et al. | |
| 5,577,686 | A | 11/1996 | Moody | |
| 5,915,647 | A | 6/1999 | Van Deurse | |
| 6,561,453 | B1 | 5/2003 | Shinga | |
| 7,942,364 | B2 * | 5/2011 | Yu Chen | B65H 75/241 242/578.2 |
| 9,211,043 | B2 * | 12/2015 | Kling | A47K 10/40 |

FOREIGN PATENT DOCUMENTS

| | | | |
|---|---|---|---|
| GB | 2 362 375 | A | 11/2001 |
| RU | 51505 | U1 | 2/2006 |
| WO | WO 95/24147 | A1 | 9/1995 |
| WO | WO 96/23719 | | 8/1996 |

OTHER PUBLICATIONS

Australian Office Action dated Jun. 13, 2013 issued in the corresponding Australian Patent Application No. 2007229981 (4 pages).
Extednded European Search Report dated Jan. 17, 2014, by the European Patent Office in corresponding European Patent Applicaton No. 13189201.0 (7 pages).

* cited by examiner

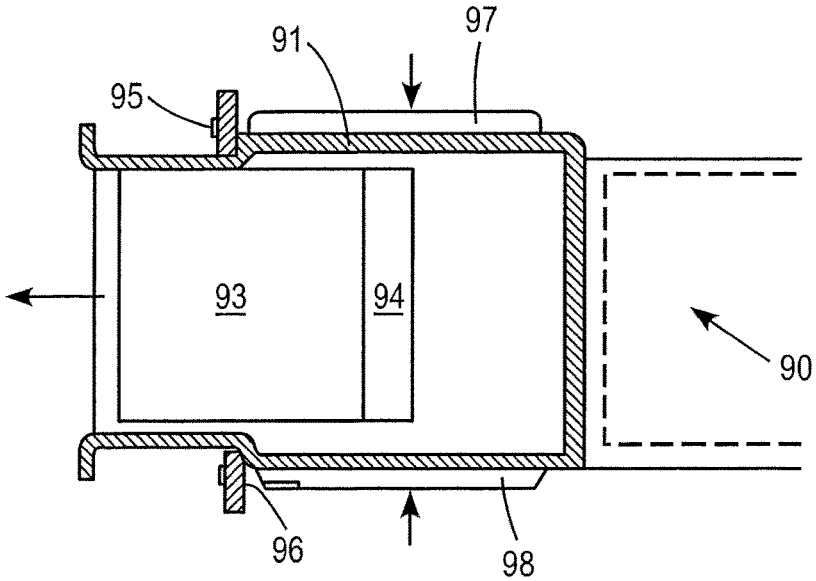
Fig. 23
Fig. 24
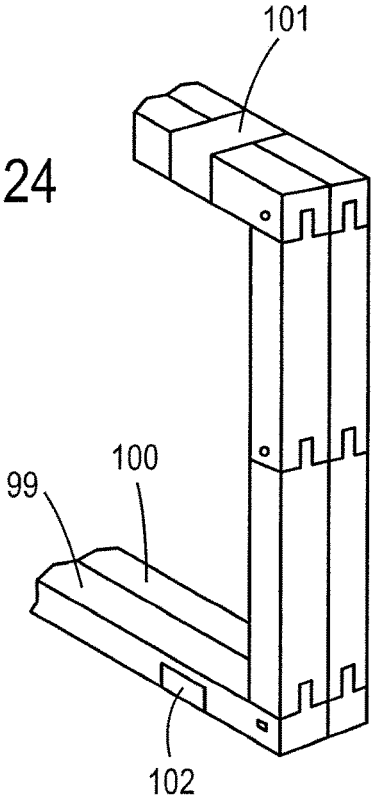

END PLUG FOR A PAPER ROLL

CROSS REFERENCE TO RELATED APPLICATION

This application is a divisional of U.S. patent application Ser. No. 12/280,167, filed on Aug. 15, 2008, which is a National Phase of International Application No. PCT/SE2007/050055, filed Feb. 1, 2007, which claims priority to International Application No. PCT/SE2006/050043, filed on Mar. 27, 2006. The disclosure of the prior applications is hereby incorporated by reference herein in their entirety.

TECHNICAL FIELD

The present invention relates to an end plug to be inserted axially into the centre of an end of a roll of paper, said end plug being provided with a holding element adapted to hold and/or guide said end of said roll of paper in correct position in a dispenser. The invention also relates to a roll of tissue paper comprising such an end plug, a package of such rolls and a dispenser provided with such a roll

BACKGROUND OF THE INVENTION

Paper rolls for use in dispensers with automatic roll change are usually provided with end plugs having holding elements for guiding the roll to the different positions the roll have to reach in the dispenser during roll transfer. Furthermore, such holding elements also function to ensure a smooth unwinding of the paper on the roll. The holding elements protrude in use outside the opposite ends of the paper roll. The end plugs are often mounted by the manufacturer of the paper roll which means that the protruding holding elements of the end plugs makes it hard to effectively utilize available space for storing of paper rolls with end plugs and also for the storing of end plugs separate from paper rolls.

Paper rolls having end plugs with axially movable holding elements which are biased to a protruding use position by resilient elements, e.g. springs, are known from GB 2 362 375 A, U.S. Pat. Nos. 4,383,656 and 5,322,234. Although the axial movability of the holding elements primarily is there in order to facilitate a release of the paper roll from a dispenser, this feature can be used to facilitate storing and transport of the paper roll, for example by pushing the outwardly biased holding element inwardly with the help of an outer wrap around the roll as is known from U.S. Pat. No. 4,032,077 and 5,322,234.

The objective of the present invention is to provide end plugs for paper rolls which can be inserted into the ends thereof without intruding on available space for storing several of such paper rolls and without the need for wrapping said rollers and that facilitates the forming of stable packages for piles of such rolls.

SUMMARY OF THE INVENTION

This objective is accomplished by an end plug to be inserted axially into the centre of an end of a roll of paper, said end plug being provided with a holding element adapted to hold and/or guide said end of said roll of paper in correct position in a dispenser, characterised in that said end plug includes an outer sleeve having an outer end and an inner end and that said holding element is connected to said sleeve by means allowing the holding element to be axially moved from a first position to a second position, in which the holding element protrude outwardly from the outer end of said sleeve, said holding element being releasably held in said first position when moved thereto.

By the term "releasably held" is meant that the holding element will remain in the first position until it is actively removed therefrom by manual or automatic influence. The first position corresponds to a transport position in which the holding element is inserted into the outer sleeve in order to save space and in order to be protected and it is important that the holding element remain in this position until it is actively removed therefrom manually or by other means, such as automatic means arranged on a dispenser.

In a preferred first embodiment said holding element is connected to said sleeve by a toggle joint. Said holding element is preferably centrally positioned in relation to the sleeve and joined thereto via at least two toggle-links uniformly arranged around the circumference of said holding element. To advantage said toggle-links are resilient.

In a second preferred embodiment said holding element includes a central shaft which is axially and slidably movable within an inner sleeve and held in the second position by stop elements. Said shaft can include a radially projecting, axially extending element which is slidable in an axially directed slot in said inner sleeve. Preferably, said element has at least one projection which in the second position fits into a notch in said inner sleeve.

In a third preferred embodiment, the holding element is spring biased against said second position. Preferably, a mechanism for releasably holding the holding element in said first position includes a rotational locking element which in first rotational positions holds the holding element in said first position and in second alternate rotational positions allows the spring force to move the holding element to the second position.

In a fourth preferred embodiment, the holding element has slide elements which are guided by the outer sleeve during movement from the first position to the second position, and locking elements snapping into openings in a side wall of the outer sleeve when the holding element is moved from the first to the second position, thereby locking the holding element in the second position.

The invention also relates to a roll of tissue paper having at least one such end plug. Such a roll of tissue paper can be provided with a core or be coreless or be provided with a spindle connecting two opposite end plugs.

Furthermore, the invention relates to a package for a pile of such rolls, wherein the pile is contained within a sealed bag, preferably in a compressed state. The bag is preferably water-proof. Each roll in the pile can be individually wrapped with a moisture sensitive wrap.

The invention also relates to a method of packaging such a pile of such rolls, said pile having a top side, a bottom side and four lateral sides, comprising the steps of applying a compressive force on at least two lateral sides, threading a bag over the pile while maintaining said compressive force and thereafter sealing the opening of the bag.

Furthermore, the invention relates to a dispenser provided with at least one roll of tissue paper having at least one end plug according to the invention. Such a dispenser can be provided with means for bringing the holding element of an end plug according to the first, second and fourth preferred embodiments from a transport position to a use position, wherein the said means includes a gripping element for pulling said holding element outwardly when the gripping elements is moved relative to the end plug.

Such a dispenser can be provided with means for bringing the holding element of an end plug according to the third preferred embodiment from a transport position to a use position. Preferably, said means includes a pushing element on the dispenser which acts on the mechanism for releasably holding the holding element in said transport position, thereby causing the locking element to move from a first rotational position to a second alternate rotational position, in which the spring force moves the holding element to the use position.

Such a dispenser may also be provided with means for bringing a holding element of an end plug according to the first, second or third embodiment from a use position to a transport position before the end plug is removed from the dispenser.

BRIEF DESCRIPTION OF THE DRAWINGS

FIGS. 22 and 23 shows schematically a package station, and FIG. 24 shows schematically a part of edge-holding means present in the package station.

DESCRIPTION OF EMBODIMENTS

Figure 1:
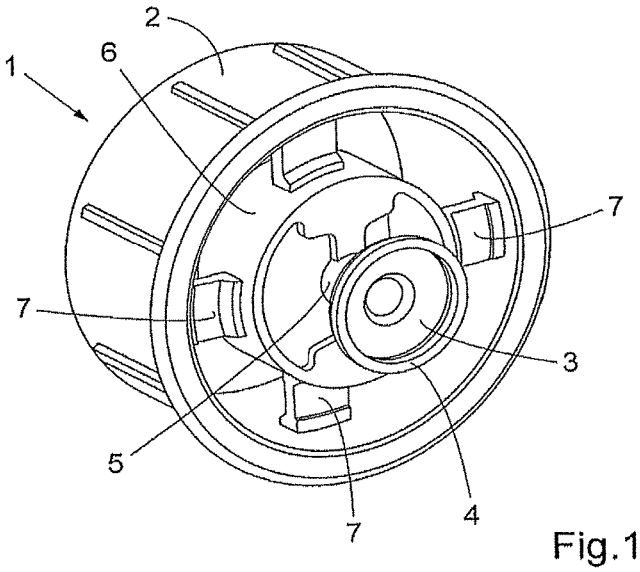
FIG. 1 shows a perspective view of an end plug according to a first embodiment of the invention with the holding element in use position.
Figure 2:
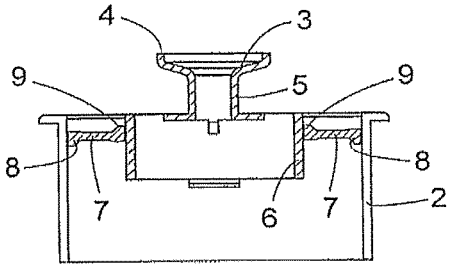
FIG. 2 shows a cross-sectional view of the end plug in FIG. 1 with the holding element in use position.
Figure 3:
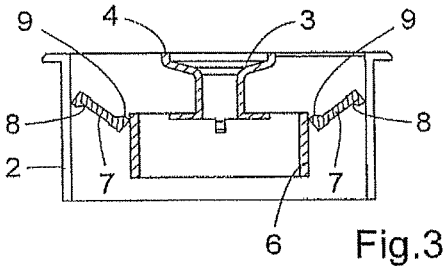
FIG. 3 shows a cross-sectional view of the end plug in FIG. 1 with the holding element in transport position.

A first embodiment of an end plug 1 according to the present invention is shown in FIGS. 1-3. The end plug 1 comprises an outer circular sleeve 2 and a holding element 3 which is concentrically disposed in relation to the outer sleeve 2. The holding element 3 comprises a head 4 and a stem 5 projecting outside a plane passing through the outer end of the sleeve 2, i.e. the end containing the holding element 3. The inner end of the holding element 3, i.e. the end opposite to the end containing the head 4, is connected to an inner sleeve 6 which in turn is connected to the outer sleeve 2 via a toggle joint comprising four toggle links 7. A toggle joint is characterized by having two stable positions between which the object held by such a joint can be moved. In FIGS. 1 and 2 a second position, a use position, of the toggle joint and thereby the holding element 3 is shown and in FIG. 3 a first position, a transport position, of the toggle joint and thereby the holding element is shown. The holding element 3 is moved from the use position to the transport position by simple pushing on the head 4 thereof. In the transport position shown in FIG. 3, the head 4 does not reach outside a plane through the outer end of sleeve 2. The outer sleeve 2 is adapted to be inserted into a centre hole in a paper roll and the holding element 3 of an end plug 1 according to the present invention will therefore not intrude on available space outside such a roll when the holding element have been pushed into the stable transport position. It is also to be noted that when the holding element is put in the transport position it is located within the outer sleeve 2 and is therefore to a high degree protected from being damaged by other end plugs or other possible hard objects when handled during storing and transport.

As best seen in FIG. 3, the toggle links 7 are in their respective ends connected to the outer sleeve 2 and the inner sleeve 6, respectively by hinges 8 and 9. In the shown embodiment, the end plug 1 consists of one piece being moulded from plastic material and the hinges 8,9 are flexible thinner portions, so called film hinges. Even if such a construction is preferred it is of course possible to use other hinge elements than film hinges and construct the end plug from several separate parts. The hinges 8,9 are also disposed a distance from the respective proximal end of the links 7. During the movement of the holding element 3 from the transport position shown in FIG. 3 to the use position shown in FIGS. 1 and 2, the ends of the links 7 will therefore come into abutment with the walls of the outer and inner sleeves 2 and 6 shortly before the position shown in FIGS. 1 and 2 is reached. The wall of the inner sleeve 6 will then be pressed inwards in the vicinity of the connection with the links 7 and the links 7 will therefore be held between the walls of the outer and inner sleeves 2 and 6 by a clamping force as a result of the resiliency of the inner sleeve 6 when the holding element 3 has been brought into the use position shown FIGS. 1 and 2.

Figure 4:
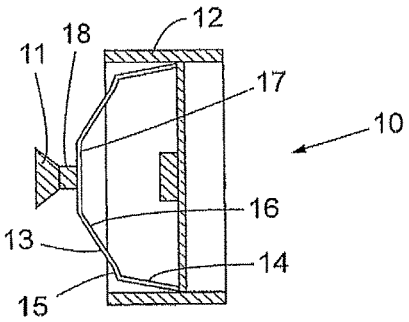
FIGS. 4 and 5 show a cross-sectional view of an end plug with an alternative embodiment of a toggle joint with the holding element in a use position and a transport position, respectively.
Figure 5:
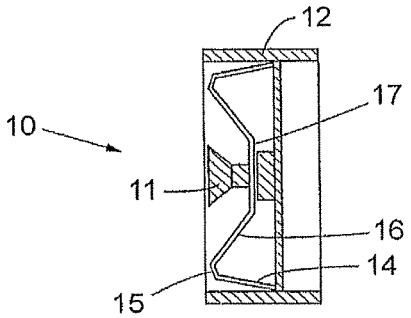

In FIGS. 4 and 5 an alternative embodiment of an end plug 10 with a holding element 11 connected to an outer sleeve 12 via a toggle joint is shown. Also in this case the toggle joint is comprised of four toggle links 13 by which the holding element 11 can be moved to-and-fro between the use position shown in FIG. 4 and the transport position shown in FIG. 5. Each toggle link 13 comprises three arms 14, 15, 16 connected to each other by hinged connections, for example film hinges. The arms 14 proximal to the outer sleeve 12 are hinged thereto and the arms 16 proximal to the holding element 11 are hinged to a plate 17 to which the stem 18 of the holding element 11 is attached.

The number of toggle links can of course be more or less than four and have different constructions than shown in FIGS. 1-5. It is, however, necessary to have at least two toggle links to reach sufficient stability for the holding element. Moreover, the toggle links can be made resilient so that the holding element have some flexibility in the use position. The shown toggle links should therefore only be regarded as preferred examples.

Figure 6:
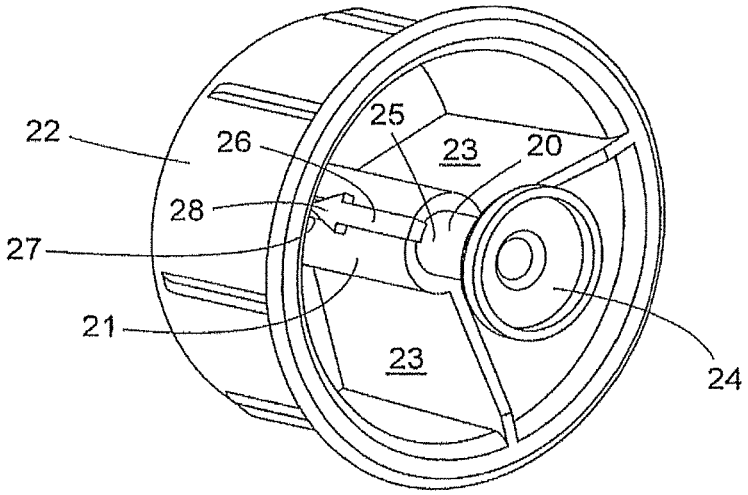
FIG. 6 shows a perspective view of an end plug according to a second embodiment of the invention with the holding element in use position.
Figure 7:
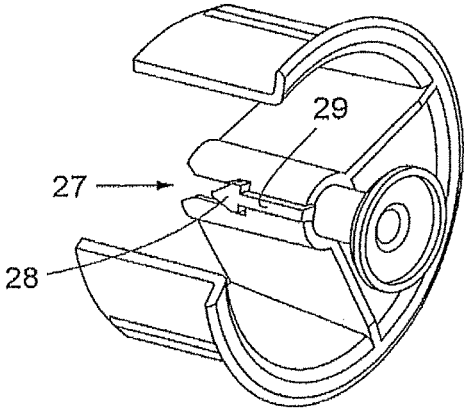
FIG. 7 shows a view similar to FIG. 6 but with a part of the outer sleeve of the end plug removed.
Figure 8:
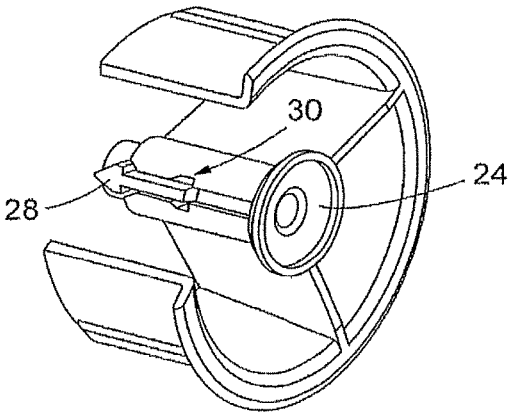
FIG. 8 shows a view similar to FIG. 7 but with the holding element in a transport position.

A second embodiment of an end plug 19 is shown in FIGS. 6-8. In this embodiment a holding element 20 is axially slidable in an inner sleeve 21 concentrically disposed in relation to an outer sleeve 22 and connected thereto via two radial walls 23 extending radially between the outer and inner sleeve. The holding element 20 is comprised of a head 24 and a stem or shaft 25 which is guided for axial movements in the inner sleeve 21. In the shown embodiment, the holding element 20 is also prevented from rotational movement within the inner sleeve 21 by a guide element 26 which is radially projecting from said stem 25 and extended in the axial direction. Said guide element 26 runs in an axially directed slot 27 in the inner sleeve 21 which is extended along the whole axial extension of the inner sleeve.

Said guide element 26 has the shape of an arrow and is thus provided with a shaft 29 and an end element 28 having the shape of an arrowhead. In order to prevent the stem from being drawn out of the inner sleeve and in order to create a use position of the holding element 20, the slot 27 in the inner sleeve 21 has a notch 30 (see FIG. 8) with a shape complementary to the shape of the parts of the arrowhead projecting outside the shaft 29 of the arrow-like element 26. Moreover, the material of the inner sleeve is resilient so that the slot 27, which is widened when the arrowhead is moved therein, can spring back to a narrower configuration when the arrowhead is axially aligned with the notch 30. When the arrowhead 28 is disposed in the notch 30, the holding element 20 is prevented from being drawn out of the inner sleeve.

Due to the resiliency of the material of the inner sleeve it is, however, possible to move the holding element 20 inwardly from the use position disclosed in FIGS. 6 and 7 to a transport position disclosed in FIG. 8. By moving the holding element 20 inwardly against the increasing force of the resilient material in the inner sleeve, the slot 27 can be widened by the sloping edges of the arrowhead 28 until the widest part of the arrowhead has left the notch 30 whereafter the inwards movement of the holding element will proceed with a substantially constant resilient force from the inner sleeve acting on the sides of the arrowhead 28. When the arrowhead reaches the inner end of the inner sleeve 21, the slot 27 is again allowed to narrow due to a bevelling of the end edges of the slot. The bevelling of the end edges of the slot 27 is made so that the widest parts of the arrowhead 28 will not extend outside the inner ends of the bevelled parts in a direction transverse to the movement of the guide element 26 in the slot 27. Thereby it is ensured that the arrowhead 28 and thereby the holding element 20 is fixed in the transport position until an outer force will move the holding element 20 from the transport position shown in FIG. 8 to the use position shown in FIGS. 6 and 7.

As is evident from FIG. 8, the head 24 of the holding element 20 is flush with the outer end plane of the outer sleeve 22 when the holding element is placed in the transport position. This means of course that the outer end of the inner sleeve 21 is distanced from said plane by a distance which is equal to or less than the axial extension of the head 24 of the holding element 20.

Instead of letting the axial movement of the holding element proceed with a resilient force acting on the guide element due to the widening of the slot, the stop positions can be obtained by notches on the guide element coincidencing with protrusion in the slot, for example snap locks. In such a case, only frictional forces will act on the holding element during movement from one position to the other after a stop position has been left. It is also possible to let the stop positions be defined by endings of the slot, possibly combined with snap locks. Another possibility is to let the stop positions be obtained by a rotational movement of the holding element, for example by having L-formed ends of slots.

Figure 11:
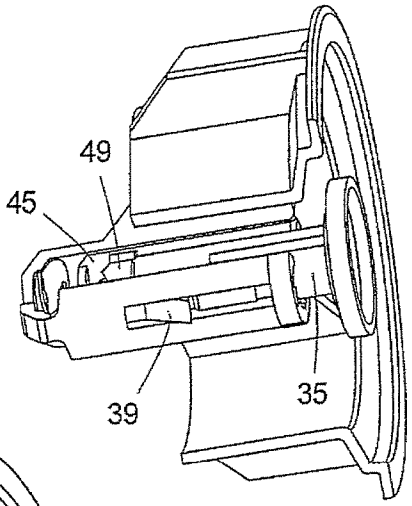
FIG. 11 shows a view similar to FIG. 10 with the holding element in a transport position and with a portion of the outer and inner sleeve removed, FIGS. 12*a,b*-15*a,b* schematically illustrate successive stages in the maneuvering of a holding element according to the third embodiment from a use position to a transport position and vice versa.
Figure 10:
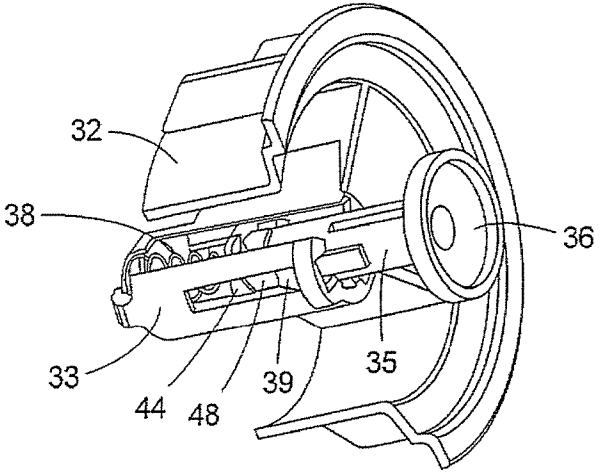
FIG. 10 shows a perspective view of the end plug in FIG. 9 with the holding element in a use position and with a portion of the outer and inner sleeve removed.
Figure 9:
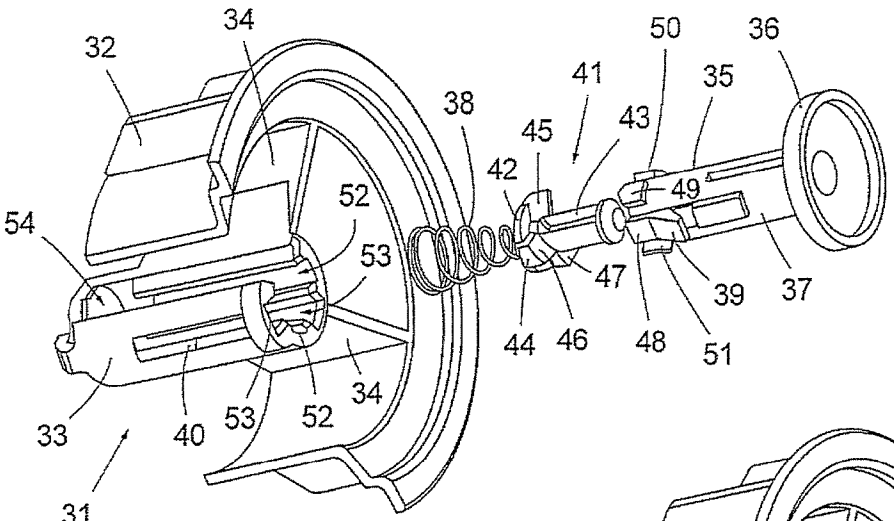
FIG. 9 shows an exploded view of an end plug according to a third embodiment of the invention with a portion of the outer and inner sleeve removed.

FIGS. 9-11 disclose a third embodiment of an end plug 31 having an outer sleeve 32 and an inner sleeve 33, concentrically disposed in relation to the outer sleeve and connected thereto by radial walls or plates 34. A holding element 35 having a head 36 and a stem 37 is axially slidable within the inner sleeve 33. The holding element 35 can be urged to a use position by a spring 38 and is prevented from being pushed out of the inner sleeve by a stop element 39 projecting radially outward from the outer surface of the stem 37 and running in an axially extending through-going groove 40 in the inner sleeve 33. The outer end of the through-going groove 40, i.e. the end facing the head 36 of the holding element 35, to which the stop element 39 is urged by the spring 38 in the use position is thus defining the use position. In the embodiment shown, the peripheral end portion of the inner sleeve 33 is thickened in the vicinity of the outer end of the groove 40 in order establish a stop surface in the upper end portion of the groove 40 to which stop surface the stop element in the use position is pressed by the force of spring 38. In FIG. 10, the end plug 31 is shown with the holding element 35 in the use position.

From the use position shown in FIG. 10 the holding element 35 can be moved to a transport position, which is shown in FIG. 11, by pushing the holding element 35 into the inner sleeve 33 against the force of the spring 38. When the holding element 35 has reached the transport position in which its head 36 does not reach outside a plane through the outer end of the outer sleeve, a locking element 41 will hold the spring in a compressed condition preventing the spring from pushing the holding element 35 to the use position.

The mechanism for controlling the locking element 41 is of a construction similar to the mechanism of a ballpoint pen in which alternate pushes on a control rod moves the ball to an outward, writing position and to an inward, non-writing position, respectively. The locking element 41 is comprised of a bottom plate 42 against which the spring 38 is pressing when the end plug 31 is assembled. The diameter of the bottom plate 42 corresponds to the diameter of the stem 37 of the holding element 35. The locking element 41 is best seen in the exploded view in FIG. 9. A central shaft 43 is protruding outward from the bottom plate 42 and fits into the hollow interior of the stem 37 of the holding element 35. When inserted into the interior of the stem 37, the shaft 43 is free to rotate therein and also to perform a limited axial movement in relation thereto. This can, for example, be accomplished by a lip or the like protruding from the outer periphery of the shaft 43 in the nose part thereof entering an opening into the interior of the stem 37 being somewhat smaller, for example 0.03-0.3 mm, than the diameter of said lip, the interior of the stem having such dimensions as to allow relative axial movement of the shaft 43 in relation to the stem 37. It is also possible to make the nose part of the shaft 43 compressible by an axial slit or the like if the materials of the stem 37 and the shaft 43 in order to facilitate entering of the shaft into the interior of the stem. The bottom plate 42 further comprises three cam followers 44-46 located around the central shaft 43 peripherally uniformly distanced from each other. The cam followers are extended in a radial direction outside the periphery of the bottom plate 42. Each cam follower 44-46 has further an outer part with an outwardly sloping surface 47. On the outside of the stem 37 are six cam elements disposed, which each have two sloping cam surfaces converging towards each other in the inner ends thereof. In FIG. 10 only four cam elements 48-51 are visible. These sloping surfaces of the cam elements project inwards of the inner end of the stem 37 of the holding element 35.

The inner sleeve 33 has six axially extending grooves for accommodating the six cam elements disposed on the outside of stem 37. These grooves are uniformly distributed along the periphery of the inner sleeve. Every second 52 of said grooves are shallow only accommodating a cam element and alternate grooves 53 have a depth enabling the passage of the cam followers 44-46, whereby one of the grooves 53 coincidences with the axial groove 40 in order to allow axial displacement of the stop element 39. The other of the grooves 52 and 53 do not go through the wall of the inner sleeve 33. In the inner end part of the inner sleeve 33, the interior of the inner sleeve opens up to a chamber 54 in which the locking plate 42 and its cam followers 44-46 freely can rotate. The bottom wall of the inner sleeve 33, i.e. the bottom of said chamber, constitutes a seat for the inner end of spring 38.

Said chamber 54 is in the outward direction, i.e. in a direction towards the head 36 of the holding element 35, limited by protrusions from the inner wall of the inner sleeve 33 which are projecting therefrom on both sides of each of said grooves 40, 52 and 53. There are thus six of these protrusions of which two 55,56 projecting from the inner wall of the inner sleeve 33 on both sides of groove 40 are shown in FIGS. 12-15. These six protrusions are also uniformly distributed around the inner wall of the inner sleeve. These protrusions are configured as sawtooth shaped cams having the sides facing the bottom wall of the chamber 54 co-operating with the cam followers on the bottom plate 42 of the locking element 41, as will be explained in later.

By this configuration of the inner sleeve 33, the spring 38, locking plate 42 with its cam followers 44-46, and the stem 37 of the holding element 35 can be axially inserted into the interior of the sleeve. During this insertion, the stop element 39 bends in order to pass the outer peripheral thickened edge of the inner sleeve 33. After passage thereof, the stop element 39 will retain its shape and prevent axial withdrawal of the holding element out of the inner sleeve. If the stop element 39 is made of a material without any resiliency, which is not preferred, and thereby will not retake its shape by itself, the stop element can be manually bent back in connection with the assembly of the end plug during manufacture thereof.

If the holding element 35 is released after the stop element has passed the outer peripheral thickened edge of the inner sleeve 33 but before the cam followers 44-46 has left the grooves 40, 52, 53 in the inner sleeve, the stop element 39 will be pressed into abutment with said thickened edge by the force of spring 38 and the holding element 35 will be in the use position shown in FIG. 10.

Figure 12A:
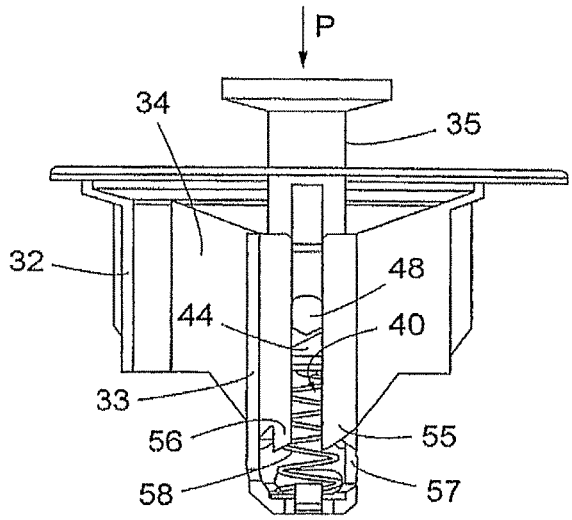
Figure 12B:
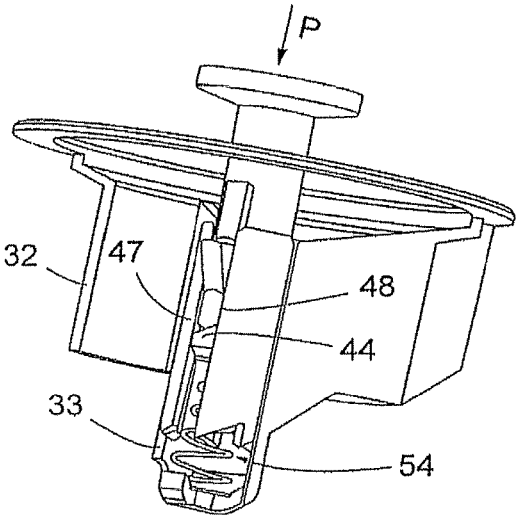
Figure 13A:
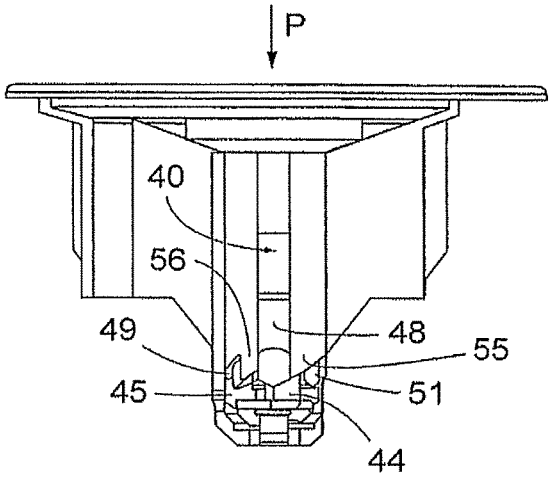
Figure 13B:
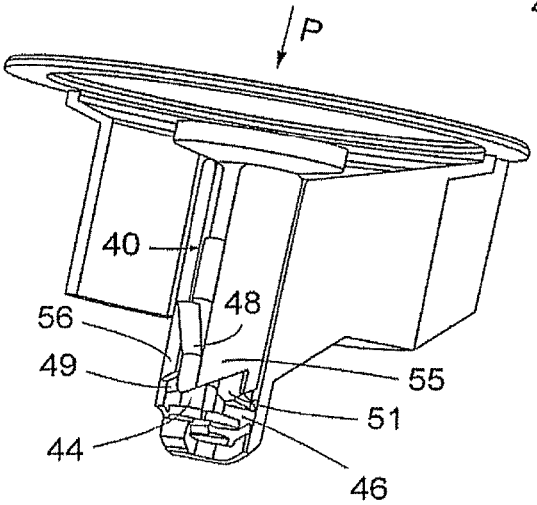

In FIGS. 12*a,b*-15*a,b* successive stages in the maneuvering of the holding element 35 from a use position to a transport position and vice versa are schematically illustrated. The FIGS. 12*a*-15*a* show the end plug 31 in a front view with parts of the respective outer and inner sleeves 32 and 33 (an outer portion thereof) taken away. The FIGS. 12*b*-15*b* show the end plug in the respective FIG. 12*a*-15*a* in a perspective view slightly from the right side and slightly from the lower side in relation to the end plugs in FIGS. 12*a*-15*a*. When the holding element 35 is pushed inwards from the use position shown in FIGS. 12*a,b* with a force P as is indicated by the arrow, the cam elements in contact with the cam followers in the grooves in the inner sleeve will push these inwards in the grooves until the cam followers enter chamber 54 in the bottom portion of the inner sleeve 33. In FIGS. 13*a,b*, the holding element 35 has been pushed to its innermost position. As is evident from FIGS. 12*a,b*, the cam element 48 abuts only a part of the cam curve 47 on the cam follower 44 when this cam follower is placed in the groove 40. The inward force on the holding element gives the cam element 48 a tendency to move the cam follower 44 to the right in FIGS. 12*a,b*, such a movement is however prevented by the walls of the groove 40. However, when the cam follower leaves the groove 40 due to the pushing of holding element 35, the cam follower is free to move to the right in the Figures and the further movement of the cam element 48 in the inward direction will result in a movement to the right of cam follower 44, i.e. a rotational movement of the locking element 41. This situation is shown in FIGS. 13*a,b*. As is evident from these Figures, the inward movement of cam element 48 in relation to cam follower 44 has resulted in a small rotational movement of the locking element 41 whereby the outer edge of cam curve 47 on cam follower 44 has passed the inner edge of protrusion 55 projecting from the inner wall of the inner sleeve 33. It is to be noted that the pushing force P on the holding element 35 still is applied. In the situation shown in FIGS. 13*a,b*, the spring 38 is maximally compressed.

When the holding element 35 then is released, the force of spring 38 will give the locking element 41 and thereby also the holding element 35 a tendency to move in an outward direction. The cam followers will by the spring force be pressed against the cam surfaces of the protrusions and will perform a movement in a rotational and an outward direction in relation to the position shown in FIGS. 13*a,b*. The cam follower 44 will be pressed against cam surface 57 on protrusion 55 and thereby moved to the right and outward in relation to the position shown in FIGS. 13*a,b*. Eventually, the cam follower 44 will reach the end of the cam surface 57 and rest in the position shown in FIGS. 14*a,b*. The cam follower 44-46 have now reached a position aligned with the shallow grooves 52 into which the cam followers can not enter. The effect of this is that the holding element 35 will be held in the transport position.

As is evident from a comparison between FIGS. 13*a,b* and 14*a,b*, the holding element 35 has also been moved outwards by the movement of the locking element 41. The last part of the outward movement of the holding element 35 is due to co-operation between the cam elements on the stem 37 of the holding element 35 and the cam followers on the bottom plate of the locking element 41. For example, cam follower 44 acts on cam element 51 and cam follower 45 on cam element 49 during the last portion of the outward movement of the holding element 35 from the position shown in FIGS. 13*a,b* to the position shown in FIGS. 14*a,b* which is its transport position also shown in FIG. 11.

Figure 14A:
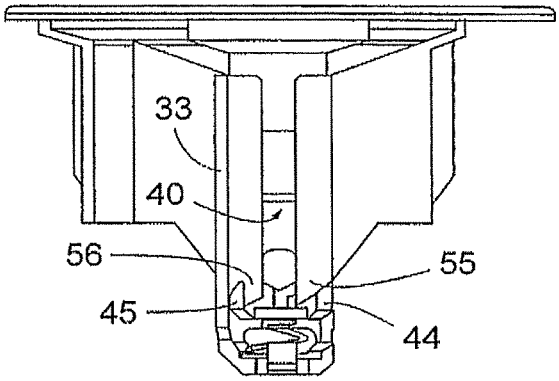
Figure 14B:
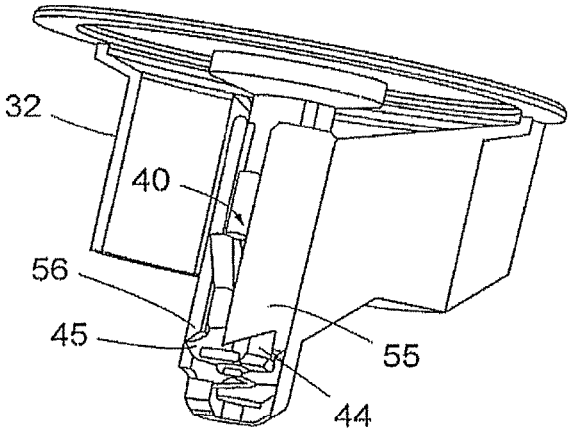

When the holding element 35 is pushed inwards from the transport position shown in FIG. 11, the cam elements located in the shallow grooves 52 are in a position to act on the cam followers 44-46 and will move these inward, i.e. downwards in FIGS. 14*a,b*, from the position shown therein. After the cam followers during this downward movement have passed the lower ends of the protrusions projecting from the inner wall of the inner sleeve 33, they will be rotated a little bit so that the upper edges of the cam followers will be within reach of cam surfaces of the protrusions 56. As is evident from FIGS. 15*a,b*, the cam surface 58 of protrusion 56 will act on cam surface 47 of cam follower 45 if locking element 41 is moved upward from the position shown in FIG. 15*a,b*.

Figure 15A:
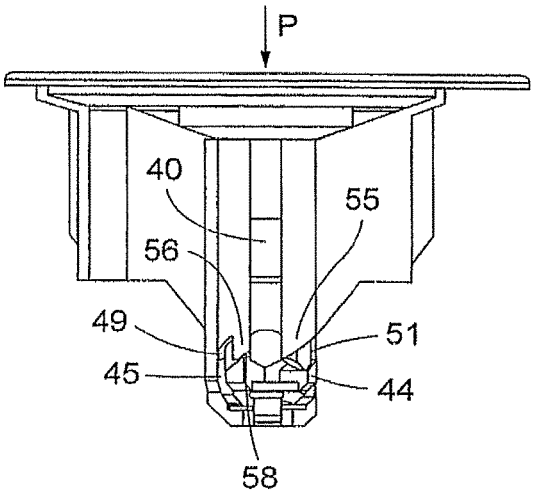
Figure 15B:
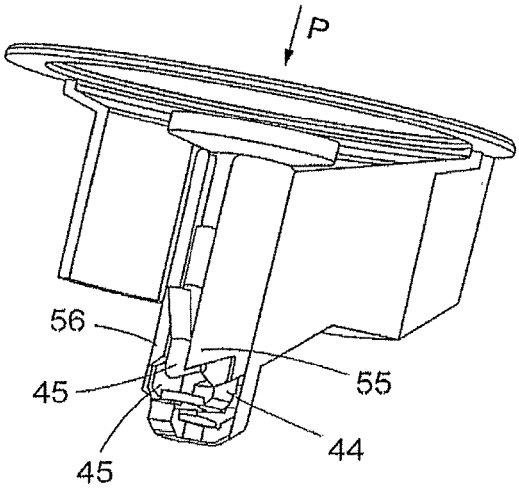

When the pushing force P on holding element 35 is released the spring 38 will tend to move the locking element 41 upward from the position shown in FIG. 15*a,b*. Cam surfaces of the protrusions, such as cam surface 58 on protrusion 56, will force the cam followers to make a rotational movement during their upward movements, cam follower 45 will be moved to the right in FIG. 15*a,b* until it will be aligned with groove 40. The rotational movement of the locking element 41 will thus align the cam followers 44, 45 and 46 with grooves 53 in the inner sleeve 33 and the force of the spring 38 will then push the holding element outward to the use position in which the stop element 39 running in the groove 40 has come to abutment with the thickened peripheral edge in the end portion of groove 40. The holding element has then been moved to the use position shown in FIG. 10.

In the disclosed embodiment only one stop element 39 is shown. However, it is of course possible to use two or three stop elements. It is of course also possible to adapt other known principles of construction for ballpoint pen mechanisms to be used instead of the disclosed mechanism.

Figure 16:
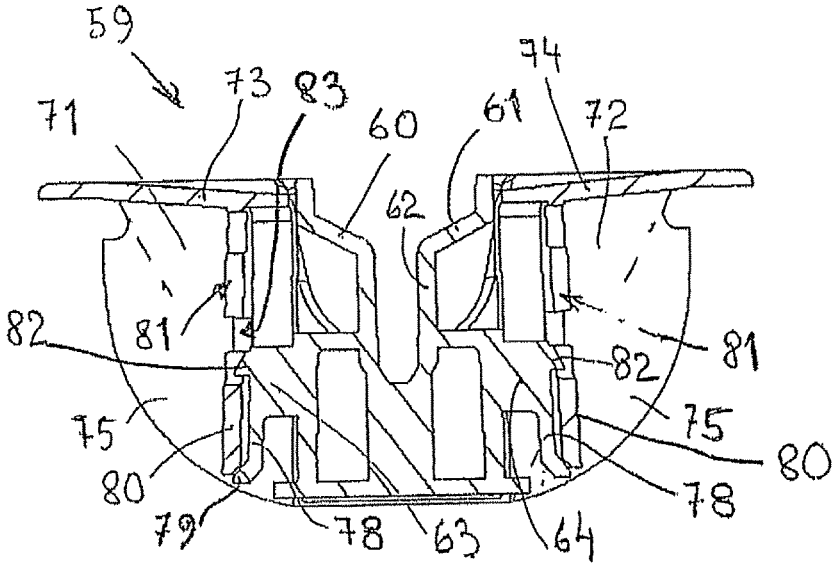
FIG. 16 shows a sectional view of an end plug according to a fourth preferred embodiment with the holding element in a transport position.
Figure 17:
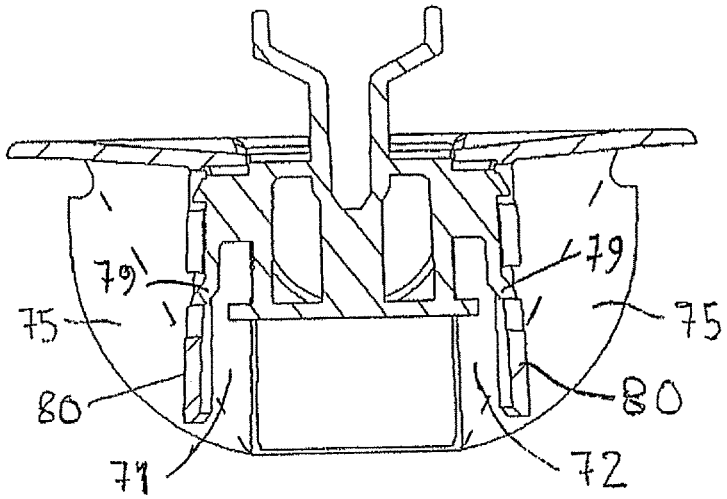
FIG. 17 shows a sectional view along line XVII-XVII in FIG. 19 of the end plug in FIG. 16 in a use position.
Figure 18:
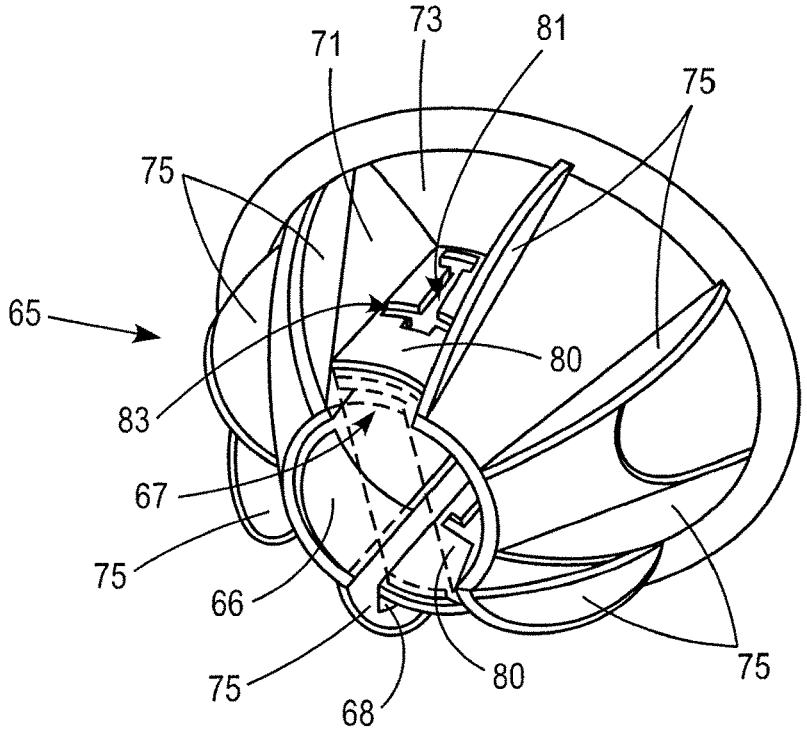
FIG. 18 shows a perspective view of the outer sleeve of the end plug in FIG. 16.
Figure 19:
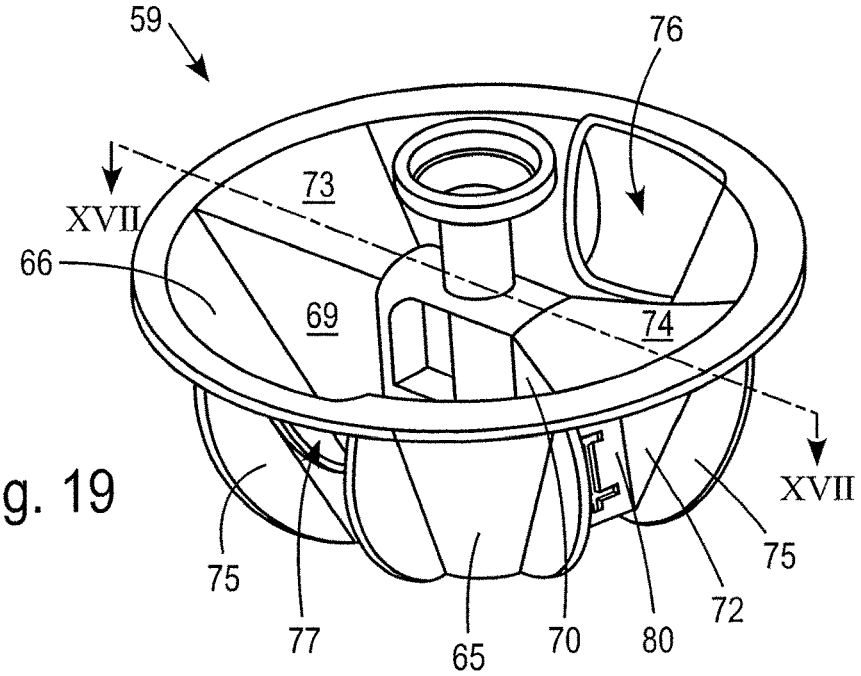
FIG. 19 shows a perspective view of the end plug in FIG. 17.

FIGS. 16-19 disclose a further embodiment of an end plug 59 with a holding element 60. The holding element 60 comprises a head 61, a stem 62 and slide elements 63, 64 extending sideways from the stem 62 in the lower half thereof. The slide elements 63,64 are slidable in an outer sleeve 65 to move the holding element 60 from a transport position shown in FIG. 16 to a use position shown in FIG. 17. For the sake of clarity, the outer sleeve 65 is in FIG. 18 shown without holding element 60. The outer sleeve 65 has a conical wall 66 extending from an outer end thereof to an inner end thereof having a smaller diameter. The outer end of the sleeve 65 is the end from which the head 61 and stem 62 of the holding element 60 project in the use position, as shown in FIG. 17. The conical wall 66 is interrupted on two diametrically opposite positions in order to let outer portions of the slide elements 63,64 pass in the openings 67,68 thereby created in the wall 66. In order to guide these portions of the slide elements 63,64, walls having inner edges directed in the axial direction, i.e. the direction of movement of the holding element 60, are extending inward in a radial direction from all side edges, i.e. the edges running from one end to the other end of the outer sleeve 65, of the openings 67,68 in the conical wall 66. In FIG. 19 three such radially extending walls 69,70,72 are visible and in FIG. 18 one such wall 71 is visible. As can be seen by FIGS. 18 and 19 the radially extending walls 69-72 have a triangular shape. The edges of the triangular walls on both sides of the respective opening 67,68 are in the outer end of the sleeve 65 connected to each other by a respective top wall 73,74. The outer sleeve 65 also comprises fins 75 radially extending from the conical wall 66, said fins 75 being equally spaced from each other in the circumferential direction. Moreover, cut-outs 76,77 are made in the conical wall 66 at two diametrically opposite locations, an imaginary line between said locations being perpendicular to an imaginary line between the openings 67 and 68.

In the cross-sectional views of FIGS. 16 and 17, which are cross-sectional views along line XVI-XVI of FIG. 19, the triangular walls guiding the movement of the holding element 60 are not visible. In order to facilitate understanding of the embodiment according to FIGS. 16-19, the border lines between triangular walls 71 and 72 and the respective fin 75 are shown with dashed lines in these Figures. As can be seen in these Figures, the slide elements 63,64 have outer parts that projects into the space between the respective pair of triangular walls 69,71 and 70,72. The contour of the underside of the holding element 60 is also shown with dashed lines in FIG. 18. The holding element 60 is thus guided by the respective pairs of triangular walls when moved from the transport position shown in FIG. 16 to the use position shown in FIGS. 17 and 19. A resilient tongue 78 with a turned out tip 79 is extended from outer side of each slide element 63,64 towards the inner end of the end plug 59. The outer end of the respective tip 79 is in the transport position shown in FIG. 16 located axially and radially outside an axially directed wall 80 extending between each pair of triangular walls at a distance from the inner edges of the triangular wall corresponding to the distance at which the slide elements 63, 64 project into the space between the respective pair of triangular walls 69,71 and 70,72. The walls 80 also have an axially extending slot 81 co-operating with a protrusion 82 on outer side of the respective slide element. Moreover, a slot 83 transversely directed to the axial direction of slot 81 is also present in each wall 80.

The end plug 59 functions in the following way.

When the end plug 59 is manufactured the holding element 60 is inserted into the outer sleeve 65 from the inner end thereof until the holding element reach the transport position shown in FIG. 16. During the insertion the protrusions 82 will press against the walls 80 until the inner end of axial slots 81 are reached. When this happens, the protrusions will pop into the slots and the tips 79 of the resilient tongues 78 will abut the inner end of walls 80. The protrusions 82 will then resist axial movement of the holding element in a direction opposite to the insertion direction due to the saw tooth shape of the protrusions. There is thus no risk that the holding element 60 will unintentionally fall out of the outer sleeve 65 after insertion and a relatively stable transport position is obtained.

When the holding element 60 shall be moved into use position, this is simply done by gripping the head 61 pulling out a portion of stem 6 from the outer sleeve 65. This movement is only resisted by the force needed to bend the resilient tongues 78 and the friction created when the tips 79 by the resiliency of the tongues press against walls 80 during the movement of the holding element 60. During the movement of the holding element 60, the protrusions 82 are guided in slots 81, thereby ensuring a purely axial movement of the holding element. When the tips 79 of the tongues 78 reach the transverse slots 83, the tips will spring back to an unloaded position and into slots 83 thereby preventing movement of the holding element 60 from the use position to the transport position. At the same time, the outer sides of the slide elements 63,64 will abut the inner sides of top walls 73,74 of the outer sleeve 65 and thereby prevent further movement of the holding element 60 out of the outer sleeve 65. The holding element will thus be positively held in its use position.

Suitable materials for end plugs according to the present invention are polypropylene (PP) or polyethylene (PE), but also other plastic materials can be used. Preferably, materials suitable for injection moulding are used. Particularly suitable materials for the second embodiment are PP for the inner sleeve and outer sleeve and PE for the holding element or vice versa. In the embodiments described, the end plugs are separate pieces but it of course possible to connect opposite end plugs by a through-going spindle, which could be constituted of an extension of the outer sleeve of an end plug.

The end plugs according to the invention are to be used together on rolls of tissue paper with or without a core, i.e. a paper cylinder around which the tissue paper is wound. The end plugs are often applied to such rolls by the manufacturer manually or by automatic means and thereby delivered to the customer in an applied state. The holding elements of the end plug are of course then brought to the transport position.

A method to package a pile of rolls of tissue paper, each roll being provided with end plugs according to the present invention, will now be described with reference to FIGS. 20-24.

Figure 20:
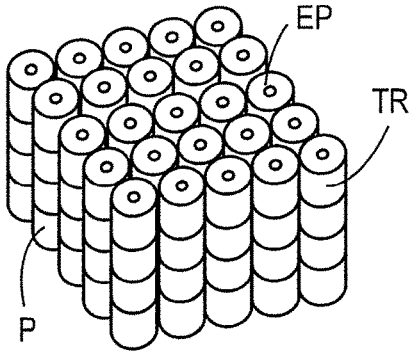
FIG. 20 shows a pile of rolls provided with end plugs.

FIG. 20 shows schematically a pile P of tissue rolls TR comprising end plugs EP according to the present invention to be packaged. The holding elements of all end plugs EP are positioned in a transport position, i.e. all parts of the holding element are located inside the outer sleeve of the end plug, the presence of the end plugs thereby not increasing the size of the pile. Each tissue roll TR could optionally be provided with a banderol wrap covering the peripheral surface of the roll. The pile P comprises a top side and a bottom side containing the ends of the rolls TR into which end plugs are inserted, and four lateral sides.

Such a pile P is in a suitable way, for example with the aid of a conveyer, brought to a package station, in which the pile P is placed in a bag which is then sealed. According to the present invention, the pile is brought to a somewhat compressed state before being placed in the bag.

The packaging line for piles P is schematically illustrated in FIG. 21*a-d*. In a first step illustrated in FIG. 21(*a*), the pile P is moved to the packaging station 84 on a suitable conveyer, such as an endless belt conveyer. When the pile P has arrived into the packaging station 84, a compressing device 85 is moved from a rest position laterally outside of the conveyer shown in FIG. 21(*a*) to a work position shown in FIG. 21(*b*).

The compressing device 85 comprises a first plate 86 which is disposed in a plane parallel to a first lateral side of the pile, and two second plates 87,88 perpendicular to the first plate 86 and thereby extending in planes parallel to second and third lateral sides of the pile, said second and third lateral sides being perpendicular to the first lateral side. The second plates 87,88 are supported by the first plate 86 and movable towards and away from each other by suitable means, such as hydraulic cylinders (not shown) located inside a hollow first plate 86.

Figure 22:
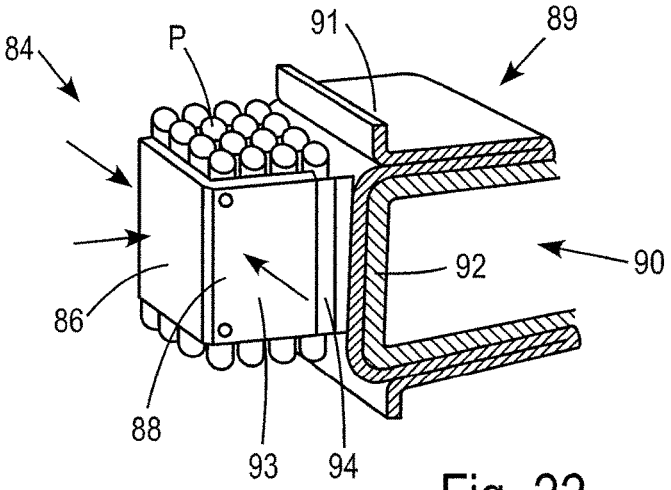

The packaging station also includes a bag-carrying device 89 comprising a bag-holder 90, onto which a bag 91 is threaded, the bottom wall of the bag being held in a stretched state against a planar side 92 of the bag-holder whereby the bottom of the bag lies opposite to the first plate 86 of the compressing device and in abutment with a fourth lateral side of the pile P, said fourth side of the pile being opposite to the first lateral side. In FIG. 22, a schematic perspective view of the packaging station 84 is shown with the bag-carrying device being shown in a partial sectional view. As can be seen in this Figure, the second plate 88 comprises an inner part 93 and an outer part 94, the outer part 94 being slidably supported in the inner part 93 and biased to an extended position by a suitable spring device. The opposite plate 87 is identically constructed as plate 88. Moreover, from this Figure it can be seen that the side wall of the bag 91 is double-folded so that the opening of the bag 91 is located close to the pile P. The bag-holding device also comprise means holding the edge of the bag, which edge-holding means are not shown in FIG. 22. These means are movable to and fro in the same direction as the first plate 86, i.e. as the compressing device as a whole.

Figure 21:
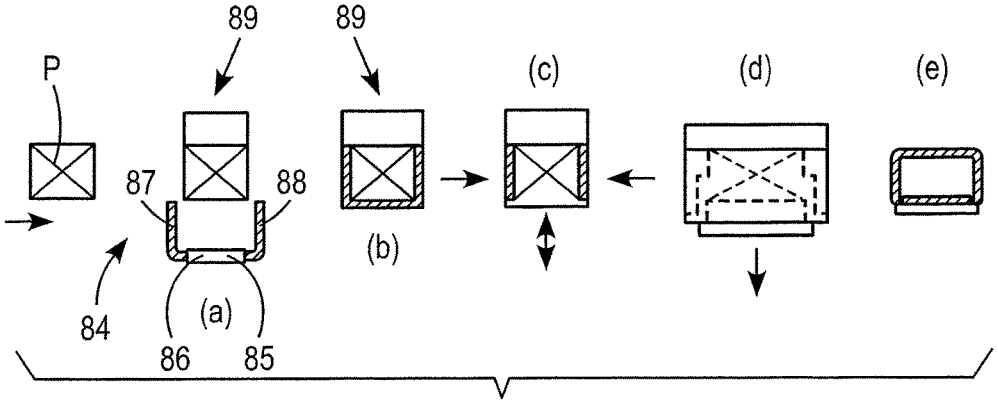
FIG. 21 illustrates schematically a method of packaging a pile of rolls provide with end plugs.

When the pile P has entered the package station and the compressing device 85 has been moved to the work position shown in FIG. 21(*b*), the side plates 87,88 of the compressing device are moved towards each other while the compressing device is as a whole moved towards bag-carrying device 89. These movements are indicated by arrows in FIGS. 21(*c*) and 22. By these movements, all lateral sides of the pile P will be moved towards opposite lateral sides, whereby all rolls TR in the pile will be pressed tightly against each other and the tissue paper in the rolls will also be somewhat compressed. It is to be noted that the movement of the compressing device towards the bag-carrying device will cause the outer parts of plates 87,88 to slide into the inner parts thereof. When the pile P has been compressed to the desired degree, the compressing position of compressing device 85 is reached and the movements of the compressing device and its plates are stopped.

Thereafter, the edge-holding means of the bag-holder 90 is moved in over the pile P thereby pulling the side wall of the bag 91 over the pile. The compressing device 85 is not moved during the movement of the side wall 91 of the bag. After the side wall 91 of the bag has been drawn over the pile P, the bag is held with stretched side wall and bottom wall by the edge-holding means. Thereafter, press bars 95,96 located in the same plane as the first lateral side of the pile P, i.e. the side against which plate 86 of the compressing device is pressing, are brought to abutment with the upper and lower part of the pile P, i.e. the parts of the pile P that project outside plate 86 in FIG. 22. It is to be noted that plates 86-88 do not cover a top and bottom portion of the pile. Optionally, a pair of press plates 97,98 can be pressed against the top and bottom sides of the pile.

Thereafter, the compressing device is moved towards its rest position. This is schematically illustrated in FIGS. 21(*d*) and 23. In the rest position, the compressing device will be located somewhat outside the opening of the bag which is still held tautened by the edge-holding means. When the compressing device has reached its rest position, the press bars 95,96 are moved towards each other, thereby closing the opening of the bag. During the movement of the press bars, the edge of the bag and consequently the edge-holding means is moved in a direction towards the pile and the top and bottom parts of the edge-holding means are moved towards each other in synchronise with the press bars. A part of an edge-holding means is schematically shown in FIG. 24. This edge-holding means consists of two square frames 99,100 between which the edge of the bag can be clamped, for example by U-shaped clamps of which two 101,102 are shown in FIG. 24. Each frame consist of two horizontal bars and two vertical bars hinged to each other, whereby the vertical bars consist of two parts hinged to each other. The horizontal bars are attached to hydraulic cylinder by pivot joins and these cylinders are pivotally supported in their sides opposite to the edge-holding means. Such edge-holding means can follow the movements of press bars 95, 96. The hydraulic cylinders are controlled to maintain the desired tension in the side wall 91 of the bag during the movement of the press bars and the accompanying movement of the edge-holding means.

By the above-mentioned arrangement the tension in walls of the bag is maintained during the closing of its opening. Preferably, one of the press bars 95,96 is provided with a welding device, such as the horn of an ultra sonic welding device, whereas the other press bar then will act as an anvil. After sealing of the bag opening, the portions of the sealed bag projecting beyond the lateral sides of the pile will be folded in and attached to the first lateral side thereof. A neat package is thereby obtained, as schematically indicated in FIG. 21(*e*).

Since the rolls in the pile P is somewhat compressed and the walls of the bag are held tautened during the sealing of the bag, a very stable package which is stackable on a pallet is obtained. Such a package will also withstand rough handling during loading and transport much better than a package of rolls which has not been subjected to compression. The compression step will also give a somewhat smaller package, the size reduction being 2-20% depending on the roll density after winding. A pre-requisite for allowing the compression of the pile P is that the rolls are provided with end plugs according to the present invention. Thereby it is ensured that no deformation of the cores of the rolls will occur, which is very important for the correct function of the rolls in a dispenser. In order to maintain the compression of the rolls in the package the bag must be made of a material that can resist the reactive forces of the compressed rolls without stretching.

In a variant of the described method of packaging a pile of rolls, only two lateral sides of the pile are compressed.

It is to be noted that it is not suitable to package rolls with end plugs having holding elements projecting out from the ends of the rolls in bags, since there is a risk that the holding elements or the bag is damaged during handling and transport thereof. By the use of end plugs according to the present invention bags can be used instead of paper board boxes, bags being made of a cheaper material. If also a compression is made, in accordance with the preferred embodiment of the method described, a very stable package (bag) is obtained. However, even if such a compressed package is preferred, the invention shall cover also a bag containing uncompressed rolls.

As stated above, the rolls can be provided with a banderol wrap surrounding the peripheral surface of the roll and protecting the roll from contamination before use. Such a banderol wrap can be made from a special paper that is easy to dissolve in a toilet, so that that the banderol wrap can be removed from the roll by the user and thrown into the toilet. Such a banderol wrap is sensitive to moisture which means that the material in the bag containing somewhat compressed rolls must be water-proof. Example of suitable paper material for dissolvable banderol wraps can be found within a printing paper type called SC-paper (Super Calendered paper).

A suitable material for the bag is co-extruded polyethylene (PE), i.e. HDPE (High Density Polyethylene) and LDPE (Low Density Polyethylene) are extruded in layers to reach desired strength and elongation properties. Total film thickness for such a bag is normally in the range of 35-80 μm.

The holding elements of the end plugs are brought to the use position when the rolls of tissue paper are placed in dispensers for such rolls, either by the person filling the dispensers, i.e. manually, or by co-operation with means in the dispenser side wall for forcing the holding elements to a use position. Such means can be gripping elements, such as tongues or the like, that are disposed inward of the heads of the end plugs on a roll and which will guide these heads in an outward movement during the inserting of the roll to a use position.

Many dispensers for rolls of tissue paper accommodate two or more of such rolls. In such dispensers, the first used roll moves to a position of disposal in the dispenser just before all paper thereof is used so that another roll can move into a dispensing position instead of the first roll. During the movement of the first roll from the dispensing position to the position of disposal, the dispenser is preferably provided with means for bringing the holding elements from the use position to the transport position. Such means can be a cam curve or a protrusion in the wall comprising the means, such as a groove or the like, for supporting the stem of the holding element, said cam curve or protrusion forcing the holding element inwards during the movement from the dispensing position to the position of disposal. It is relatively easy to provide dispensers for rolls with end plugs in which the movement of the holding element from use position to transport position is a pure axial movement, with such automatic means for guiding such holding elements into and out of a use position.

The lid of the dispenser can to advantage be used to provide the relative movements necessary between elements acting on the holding elements of the end plugs in order to move the holding elements between transport and use positions.

The described embodiments of end plugs can of course be modified within the scope of invention. For example, need the outer end of the holding element in the transport position not be flush with a plane through the plane of the outer end of the end plug but can lie inside such a plane. The head of the holding element need not have the shape shown in the Figures but can have any suitable shape, for example the shape of a transverse rod, the shape of a X, etc. In certain applications, for example the embodiment according to FIGS. 9-11, the head can be non-existent. In some applications, the head of the holding element can be substituted by indentations or the like in the stem thereof. The end plugs can be used together with rolls in which two end plugs are needed and guided in a dispenser or dispensers in which only one end of a roll is supported, whereby only one end plug is needed. The scope of invention shall therefore only be limited of the content of the enclosed patent claims.

What is claimed is:

1. An end plug to be inserted axially into a center of an end of a roll of paper, said end plug comprising:

a holding element adapted to hold said end of said roll of paper in a predetermined position in a dispenser; and an outer sleeve having an outer end and an inner end, and said holding element being connected to said outer sleeve such that the holding element is configured to be axially moved from a first retracted position to a second position, in which second position the holding element protrudes axially out of the outer end of said outer sleeve, wherein said holding element is locked in said second position when moved thereto, and wherein said holding element includes a central shaft which is axially and slidably movable within an inner sleeve and held in the second position by stop elements.

2. The end plug according to claim 1, wherein said shaft includes at least one radially projecting, axially extending element which is slidable in an axially directed slot in said inner sleeve.

3. An end plug according to claim 2, wherein said element has at least one projection which in the second position fits into a notch in said inner sleeve.

4. The end plug according to claim 1, wherein the holding element is spring biased against said second position.

5. The end plug according to claim 4, further comprising a mechanism for releasably holding the holding element in said first position, said mechanism including a rotational locking element which in first rotational positions holds the holding element in said first position and in second alternate rotational positions allows the spring force to move the holding element to the second position.

6. A roll of tissue paper having at least one end plug according to claim 1.

7. The roll of tissue paper according to claim 6 provided with a core.

8. The roll of tissue paper according to claim 6 provided with a spindle connecting two opposite end plugs.

9. A dispenser provided with at least one roll of tissue paper according to claim 6.

10. The dispenser according to claim 9 provided with means for bringing the holding element of an end plug from a transport position to a use position, wherein said means includes a gripping element for pulling said holding element outwardly when the gripping elements is moved relative to the end plug.

11. The dispenser according to claim 9 provided with means for bringing the holding element of an end plug from a transport postition to a use position.

12. The dispenser according to claim 9 provided with means for bringing the holding element of an end plug from a transport position to a use position, wherein a pushing element on the dispenser acts on a mechanism for releasably holding the holding element in said transport position thereby causing a locking element to move from a first rotational position to a second alternate rotational position, in which a spring force moves the holding element to the use position.

13. The dispenser according to claim 9 provided with means for bringing a holding element of an end plug from a use position to a transport position.

14. A coreless roll of tissue paper having at least one end plug according to claim 1.

15. The end plug according to claim 1, wherein said holding element includes a hollow portion, and the central shaft is slidably movable inside the hollow portion of the holding element.

* * * * *